US006935144B2

(12) United States Patent
Lakshmanan et al.

(10) Patent No.: US 6,935,144 B2
(45) Date of Patent: Aug. 30, 2005

(54) DEVICE FOR LEATHER PROCESSING

(75) Inventors: Duraiswamy Lakshmanan, Chennai (IN); Bommya Thangaraj, Chennai (IN); Subramaniyam Krishnan, Chennai (IN); Natesan Samivelu, Chennai (IN); Paruchuri Gangadhar Rao, Chennai (IN); Thirumalachari Ramasami, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 161 days.

(21) Appl. No.: 10/393,388

(22) Filed: Mar. 20, 2003

(65) Prior Publication Data

US 2004/0182118 A1 Sep. 23, 2004

(51) Int. Cl.[7] ..... C14C 1/00
(52) U.S. Cl. ..... 69/30; 69/29; 69/31
(58) Field of Search ..... 69/1, 29, 30, 31, 69/32; 68/142, 144; 134/120; 366/228

(56) References Cited

U.S. PATENT DOCUMENTS

| | | | | | |
|---|---|---|---|---|---|
| 922,415 | A | * | 5/1909 | Glasel | 69/30 |
| 3,426,557 | A | * | 2/1969 | Pillard | 69/30 |
| 3,664,161 | A | * | 5/1972 | Cressman | 69/30 |
| 3,841,909 | A | * | 10/1974 | Nonaka et al. | 134/5 |
| 3,913,360 | A | * | 10/1975 | Holdsworth | 69/30 |
| 3,919,865 | A | * | 11/1975 | Glandfield | 69/30 |
| 4,118,959 | A | * | 10/1978 | Waite | 69/30 |
| 4,122,692 | A | * | 10/1978 | Dose | 69/30 |
| 4,424,690 | A | * | 1/1984 | Gili Bas | 69/30 |
| 4,441,342 | A | * | 4/1984 | Dose et al. | 69/30 |
| 4,519,224 | A | * | 5/1985 | Seifert et al. | 69/30 |
| 4,836,099 | A | * | 6/1989 | Thirode | 99/472 |
| 6,151,932 | A | * | 11/2000 | Molto et al. | 69/30 |

FOREIGN PATENT DOCUMENTS

| | | |
|---|---|---|
| GB | 1116885 | 6/1968 |
| RU | 2078828 | 5/1997 |
| WO | 0040761 | 7/2000 |

OTHER PUBLICATIONS

Database WPI, Section CH, Week 199747, Derwent Publications Ltd., London, GB, Class D18, AN 1997–510931, XP002247335 & RU 2 078 878 C, dated May 10, 1997, English Abstract.

Leather Technician's Handbook, Appendix 7, pp 543–547 (1971) Mechanical Action of Drums published by Leather Producers' Association.

Tombetti, F., et al "Tanning in Pressurized Environment" Abstract published in Journal of American Leather Chemists Association, vol. 75, No. 62, (1980) English Translation of Italian Text.

* cited by examiner

*Primary Examiner*—Gary L. Welch
(74) *Attorney, Agent, or Firm*—Ladas and Parry LLP

(57) ABSTRACT

An improved device for leather processing comprising a vessel containing perforated dummy doors and compartments with pegs as well as friction disk fixed along the exterior periphery of the vessel. The leathers to be wet processed are subjected to mechanical action in terms of both rocking action as well as rotational movement simultaneously. The perpetual motion of the device help to create pressure generation for quickening the process and for addition of chemical solution continuously. The processing takes place under pressure generated inside the vessel and with the support of multiple mechanical actions, resulting in higher exhaustion of bath with less processing time and energy requirement and higher capacity utilization to produce good quality leather.

14 Claims, 8 Drawing Sheets

DEVICE FOR LEATHER PROCESSING

FIELD OF THE INVENTION

The present invention relates to an improved device for leather processing. The device of the present invention has potential application in pre-tanning, tanning and post tanning wet operations in leather processing industry.

BACKGROUND OF THE INVENTION

Wet processing of hides and skins are conventionally done in pit, vat, paddle and wooden drum. While using pit and vat, the hides/skins are put into the process liquor and handled manually. It has prompted the tanners to use paddle to impart the agitation in the to liquor by rotation of the blades of the paddle using motor and gearbox, thereby providing mechanical agitation to the stock to be processed. Much better effect of the desired mechanical action under dynamic condition on the hide/skin to be processed is however provided in a tanning drum, which has been in use since 1903. Rotational movement of the drum ensures that the skins/hides are first lifted up by the shelves or pegs and then allowed to fall down under gravity to the processing liquor, resulting in considerable mechanical action. As reported by Sharphouse (Leather Technician's Hand book—year 1971, Appendix 7 Pages 543 to 547 published by Leather producer's association) and K. T. Sarkar author and publisher (Theory and practice of leather manufactures—$5^{th}$ edition, year 1997—pages 732–761) this conventional drumming is associated with the following limitations.

a) It involves the possibility of damage of the sides/skins under processing, by scrapping, scuffing, knotting, shape distortion, wrinkling grain pebbling, loosening of fiber structure or loss in area.

b) It is associated with difficulty in thorough cleaning of the stock, which lets out lot of water adding to the effluent disposal problem.

c) It involves the inconvenience in opening the drum for unloading and other intermittent checking.

d) Since the float of the drum cannot go beyond the axle level, the capacity utilization is very low to the tune of only 35% of the volume of the drum.

e) Moreover, the turbulence generated in a tanning bath due to the rotational movement of the device results not only in reduced diffusion of chemicals, but also in enhanced friction among the surfaces of the skins/hides, thereby contributing to the degradation of the quality of the final leather.

f) To process in short float as a measure against effluent problems, which requires strengthening of drum drives, a higher motor power is required for safe and efficient running.

g) Normally, the required starting torque, which plays an important role in the selection of motor for any application, is very high to the tune of 3 times of the running torque due to the following reasons.

1. Concentrated load of the hide/skin
2. Self-weight of the wooden tanning drum,
3. Friction because of the journal bearings and
4. The possible spur gear errors.

It is thus obvious that the motors used for running the drums are usually oversized to take care of starting torque, resulting in poor efficiency under normal running condition.

The above limitations have prompted the researchers to explore better options for leather processing device. Tombetti et al (Abstract published in Journal of American Leather Chemists Association, 75, 62, 1980) developed a pressure vessel for leather tanning having a rotating inner drum (2) divided into three perforated compartments, each having a door (6), housed in a stationary exterior casing (1) provided with a door (7) and an inlet for chemical and water housed on a frame assembly (3), the said inner drum (2) being rotated with the help of main shaft (4), held by two bearings and housing (5) and connected to a power transmission assembly source (8), the pressure inside the inner drum (2) being generated with the help of a pneumatic system (9).

It has been possible to enhance the capacity utilization to about 60% due to the provision of plurality of compartments provided in the pressure vessel. Moreover, the distribution of load, while the vessel is in motion ensures that the starting torque required for running the device is around 2 times of the running torque, thereby suggesting economy in energy consumption. Nevertheless, the pressure vessel is also associated with the following limitations. Association of moving parts with the inner vessel, which is connected to a rotating main shaft, has greater implication of wear and tear, that is likely to result in leakage of air, thereby causing loss of pressure inside the vessel. The stationary outer shell does not provide any option for automatic unloading of the leathers, which have to be taken out manually, thereby implying more labor as well as time.

Our copending Indian patent application No. 791/DEL/2000 has been an attempt towards obviating the aforesaid limitations by way of providing an improved tanning device comprising a perforated inner vessel (15) having shelves more than one (17) and a door (16) the said inner vessel (15) being housed on non-corrosive chemical resistant rollers (18) fixed on the inner wall of the outer vessel (22) made up of a non-corrosive material capable of withstanding pressure of minimum 5 $Kg/cm^2$, and the said outer vessel (22) being provided with a leak-proof packing (21) and dome shaped caps (20) on either side, the said outer shell being provided with inlet for chemicals and water (23), conventional regulated temperature device (24), discharge for liquid (26), a pressure nozzle (25) connected to a compressor and regulator externally (not shown in the drawing) for developing air pressure inside the vessel, the entire oscillating exterior shell (10) along with all accessories defined herein before being placed on center shaft (not shown in the drawing) being attached to the frame assembly (11) the conventional rocking mechanism (13) being provided on the outer shell and connected to the normal power transmission assembly (12) in turn connected to the mechanism for rotating action (14) thereby ensuring rocking action as well as rotational movement of the inner perforated vessel (15) with the help of non corrosive chemical resistance gear (19) fixed on the outside of the inner vessel (15).

The main advantages of this device over the known pressure vessel are the following.

1. Unlike the known pressure vessel, where only rotary motion is possible, this device provides option for both oscillatory as well as rotary motion.

2.The outer shell of the device undergoes rocking action, which enables an operator to adjust it in a convenient position so as to unload the processed stock by gravity automatically, thereby not only doing away with the extra labor associated with unloading, but also in reducing unloading time.

3. Since the inner vessel is rotated by the rollers fixed to the inside of the outer shell of the device, no leakage of internal pressure is envisaged and at the same time long life is ensured for the device.

4. Unlike the existing systems, the starting torque of the deice is only about 1.5 times of the running torque as against much higher values for the existing devices, thereby reducing the power requirement considerable.

5. Capacity utilization of the device is around 70% as against 45% in the existing wooden drum.

6. Even without opening the vessel door, the critical parameters like pH, temperature of the float can be measured only by opening the outlet.

However, the device is still constrained by the following limitations. The device provides a two-vessel system having an outer casing as well as an inner vessel, thereby escalating not only the fabrication complexities, but also cost.

An external energy source is required in the form of an air compressor to form a pneumatic system, thereby adding to cost. The device does not provide, like the conventional tanning drums, any option for automatic mixing of chemicals inside the drum, thereby implying the requirement of proper mixing of chemicals.

OBJECTS OF THE INVENTION

The main objective of the present invention is to provide an improved device for leather processing, which obviates the drawbacks stated above.

Another objective of the present invention is to provide a single vessel system exhibiting both oscillatory as well as rotary motions like upward and downward directions with less noise.

Yet another objective of the present invention is to provide a leather-tanning device to employ pressure technique and at the same time to maintain the internal pressure while processing leathers.

Still another objective of the present invention is to provide a device exhibiting provision for automatic unloading of the processed stock.

Another objective of the present invention is to increase the capacity utilization of the vessel to more than 75%.

Still another objective of the present invention is to ensure that the power consumption and the processing time are reduced as compared to those in the similar operations in respect of the devices known in the existing art.

Yet another objective of the present invention is to provide a device to process in short float as a measure against effluent problems by consuming lesser energy compare to the conventional tanning drum.

Still another objective of the present invention is to provide a device exhibiting provision for the chemical addition manually or mechanically.

SUMMARY OF THE INVENTION

Accordingly the present invention provides an improved device for leather processing comprising a cylindrical vessel (27) encasing a plurality of perforated longitudinal compartments (39) fitted with a plurality of pegs and having at least two dome shaped caps (31) on either side along the horizontal axis, at least one of said caps being openable, all the caps being provided with respective co-centric inlets (46) and respective bottom draining outlets (45), the caps being connected internally by a perforated dummy disc door (42) having a leak proof packing (44), the vessel (27) being provided with a peripheral openable aperture (43), and at least two friction bands (28) fixed on its exterior periphery, said bands (28) being provided on the side thereof with supporting roller assembly (40) capable of preventing any slip during motion, the vessel being placed on friction rollers (34), the said rollers being rotated through connecting shafts (35) by a power transmission source (39) capable of causing rotary motion of the vessel (27) in upward as well as downward directions, the entire vessel and all its elements above being connected to a rocking/oscillating assembly (36) in turn connected to a second power transmission source (37), so as to provide a combination of rotary and oscillatory motion.

In one embodiment of the invention, the bottom of the rocking/oscillating assembly (36) is provided with an air generation means (47), an air chamber (48), a plurality of valves (49), air lifters (50), and chemical container (51) all connected and forming a self generating pneumatic system for continuous addition of chemicals during processing, thereby ensuring the addition of liquid either manually or by the said pneumatic system through the inlet (46), the entire assembly being held by a main shaft (32) supported by two bearings, the said shaft being held by a frame assembly (30).

In another embodiment of invention, the opening as well as closing of the openable cap being controlled by a clamp (29)

In another embodiment of the invention, the vessel, dome shaped cap, chemical container and perforated dummy door are made of a material chosen from the group consisting of non-corrosive stainless steel, chemical resistant fiberglass reinforced polymer and seasoned wood.

In another embodiment of the invention the material used for friction disk, supporting roller assembly, friction roller, frame assembly, rocking/oscillating assembly, rotating assembly, main shaft, connecting shaft, clamp mechanism, are selected from the group consisting of stainless steel, mild steel, cast iron, Teflon, nitrile rubber and fiber glass reinforced polymer.

In yet another embodiment of the invention, the bearings are selected from the group consisting of a self-aligned bearing, journal bearing and ball bearing.

In another embodiment of the invention, the friction rollers are made from a material selected from the group consisting of nitrile rubber, Teflon, polyvinyl chloride, polyurethane, cast iron, brass and aluminum.

In another embodiment of the invention, the power transmission source comprises an electric motor.

In another embodiment of the invention, the openable dome shaped cap is opened and closed by opening means selected from the group consisting of a bolt and nut assembly, rack and pinion assembly, pneumatic assembly and a cam assembly.

In yet another embodiment of the invention, the rocking/oscillating assembly is selected from the group consisting of a cam mechanism, connecting rod mechanism, hydraulic system and a spatial mechanism.

In another embodiment of the invention, the driving mechanism to rotate both upward and downward directions for the connecting shaft used is selected from the group consisting of a gear drive, chain drive and a belt drive.

In yet another embodiment of the invention, the leak proof packing material used is selected from the group consisting of hardened rubber, nitrile rubber and spongy rubber.

In another embodiment of the invention, the air generating means is selected from the group consisting of piston cylinder, air pumps and bellows.

In yet another embodiment of the invention, the air chamber and air lifter are made of a material selected from the group consisting of stainless steel, mild steel and brass.

BRIEF DESCRIPTION OF THE ACCOMPANYING DRAWINGS

DETAILED DESCRIPTION OF THE INVENTION

Figure 1:
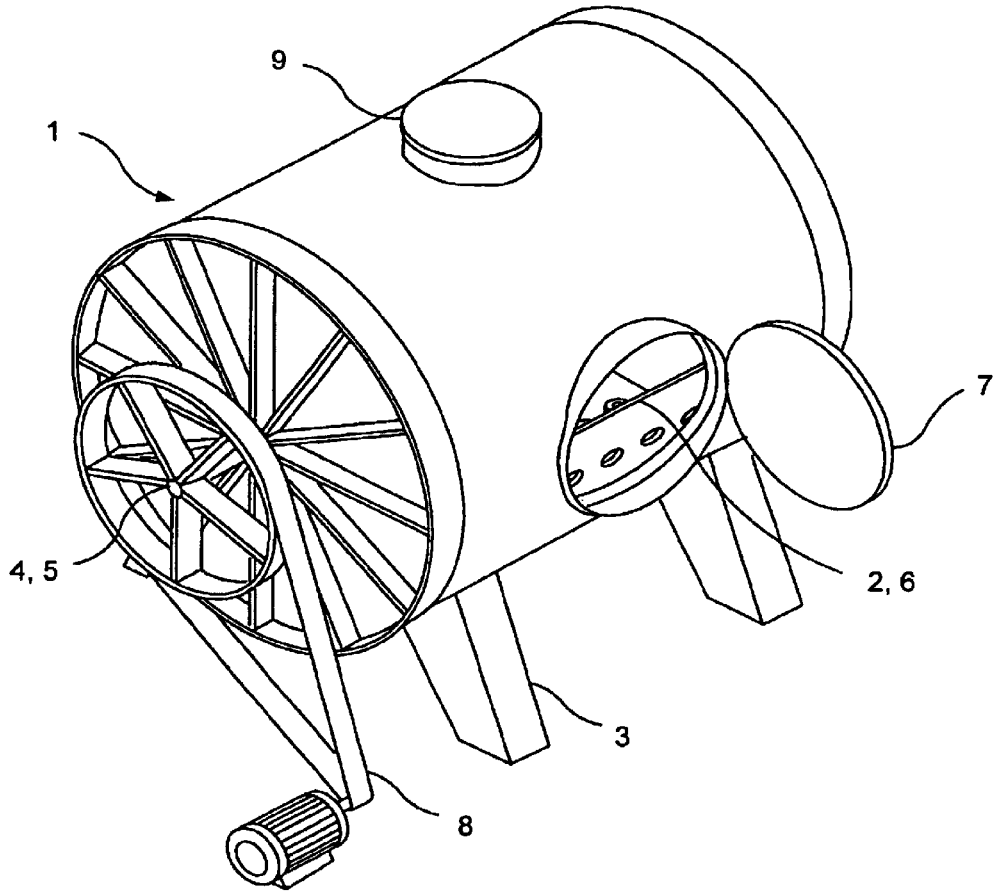
F I G. 1 PRIOR ART
FIG. 1 represents the assembly of the prior art pressure drum as described in Tombetti et al, Journal of American Leather Chemists Association, 75, 62, (1980).

The device of the present invention is described below in detail with reference to the accompanying drawings. In the drawings accompanying this specification:

Different parts of FIG. 1 (prior art drum assembly) are as follows.

1. refers to the stationary exterior casing
2. refers to the perforated inner rotating drum
3. refers to the frame assembly
4. refers to the center shaft
5. refers to the bearings and housings
6. refers to the perforated three compartments with each one door.
7. refers to the door to the exterior casing.
8. refers to the power transmission source.
9. refers to the inlet for chemical and water and with pneumatic system.

Figure 2:
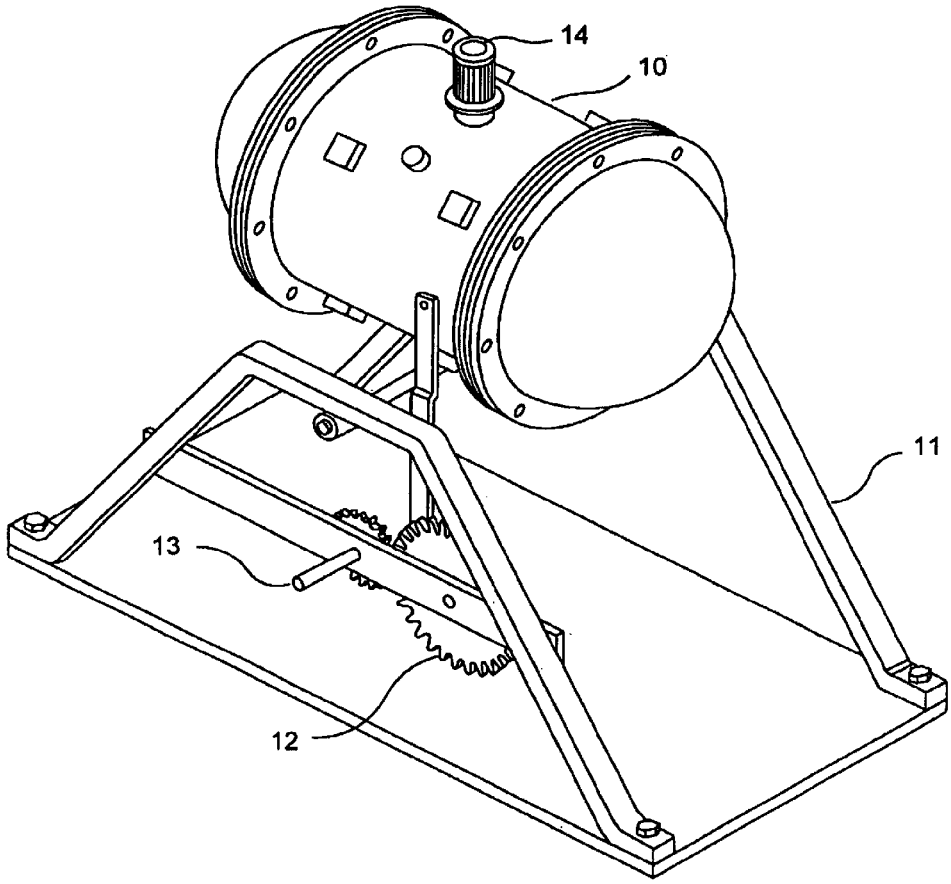
F I G. 2 PRIOR ART
FIG. 2 represents the assembly and parts of the improved tanning device (ITD), as described in our co-pending patent application no. 791 DEL 2000.

Different parts of FIG. 2 (prior art) are as follows

Figure 3:
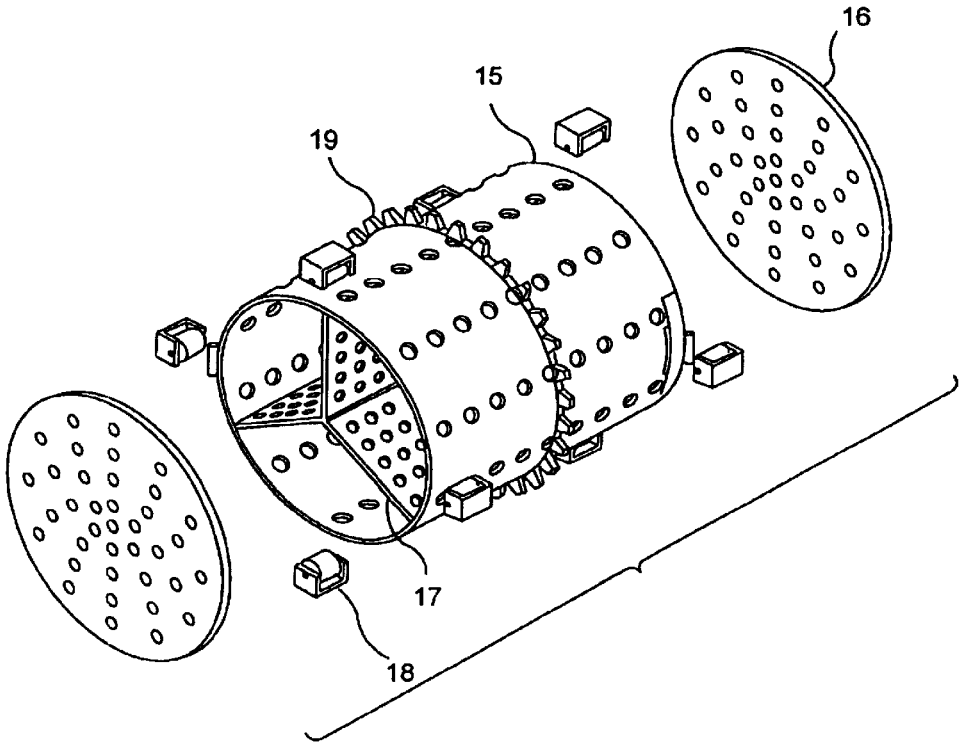
FIG. 3 represents the parts of the inner vessel of the ITD of FIG. 2.

10. refers to the oscillating exterior shell.
11. refers to the frame assembly.
12. refers to the power transmission assembly.
13. refers to the mechanism for rocking action of the device
14. refers to the mechanism for rotating action of the device Different parts of FIG. 3 (prior art) are as follows.

Figure 4:
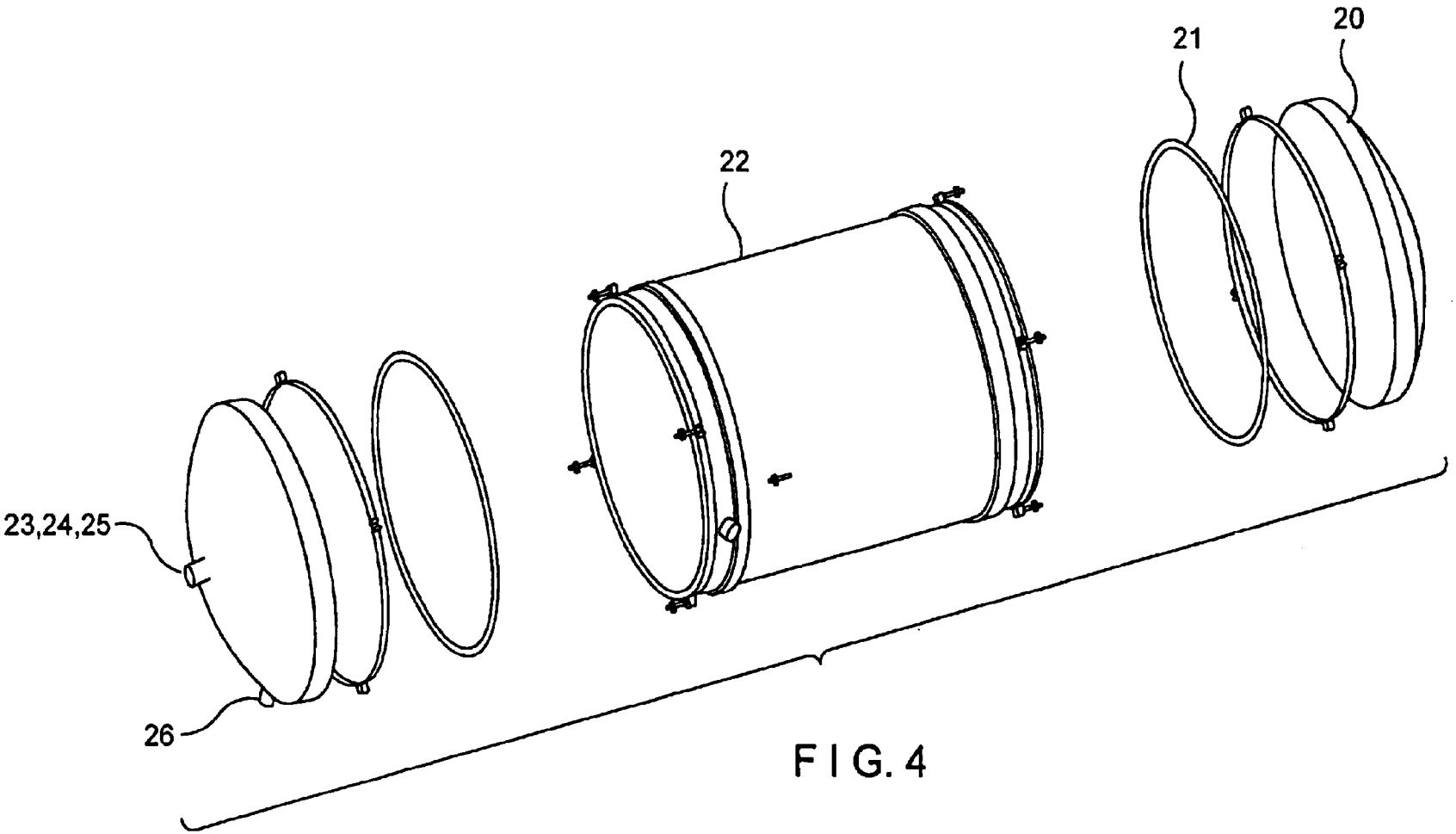
FIG. 4 represents the parts of the shell of the ITD of FIG. 2.

15. refers to the perforated inner vessel
16. refers to doors of the inner vessel
17. refers to the shelves/compartments inside the inner vessel
18. refers to the rollers fixed on the inner side of the outer vessel
19. refers to the pinion and gear fixed on the outer side of the inner vessel Different parts of FIG. 4 (prior art) are as follows.

Figure 5:
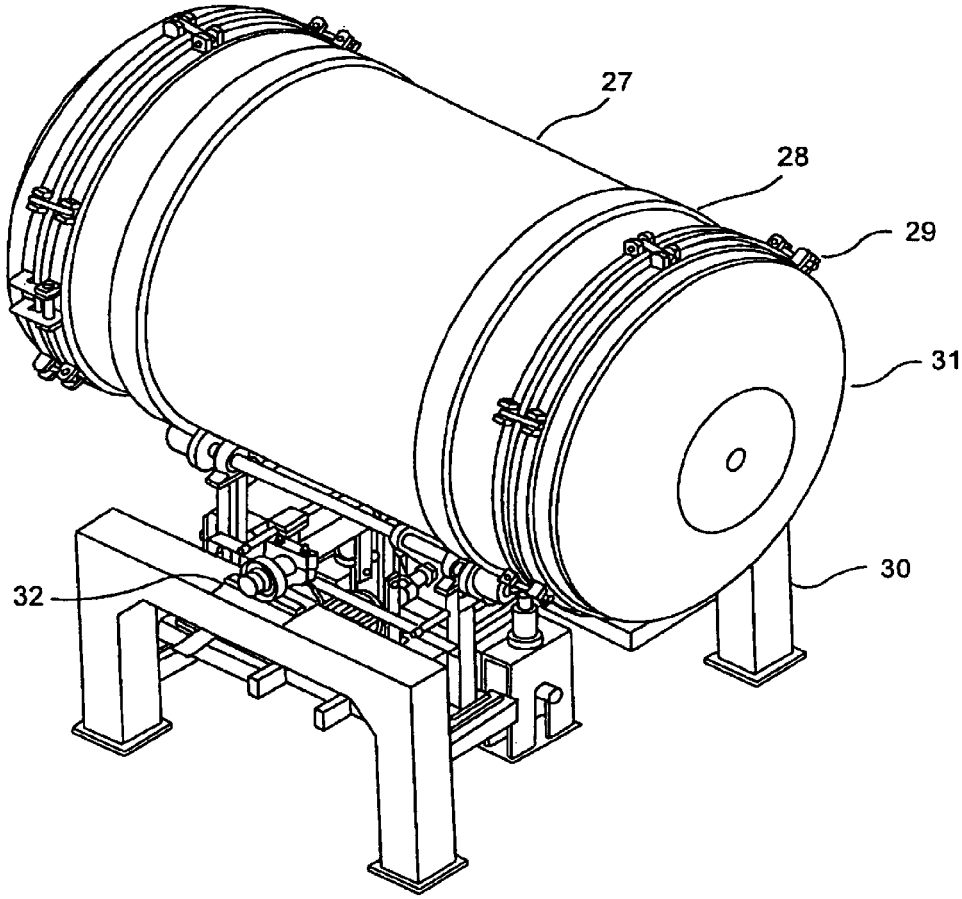
FIG. 5 represents the assembly and parts of the Improved Device for Leather Processing (IDLP) of the present invention.

20. refers to the dome shaped caps
21. refers to the leak proof packing
22. refers to the outer vessel
23. refers to the inlet for chemical and water
24. refers to the conventional regulated temperature device
25. refers to the nozzle connected with pressure regulator and compressor
26. refers to the outlet for discharging liquid Different parts of FIG. 5 (present invention) are as follows

27. refers to the oscillating cum rotating light weight vessel of IDLP.
28. refers to the friction disk.
29. refers to the mechanism to fix the dome shaped cap to the vessel.
30. refers to the frame assembly to hold the vessel with entire mechanisms.
31. refers to the dome shaped cap.
32. refers to the main shafts held by bearings.

Figure 6:
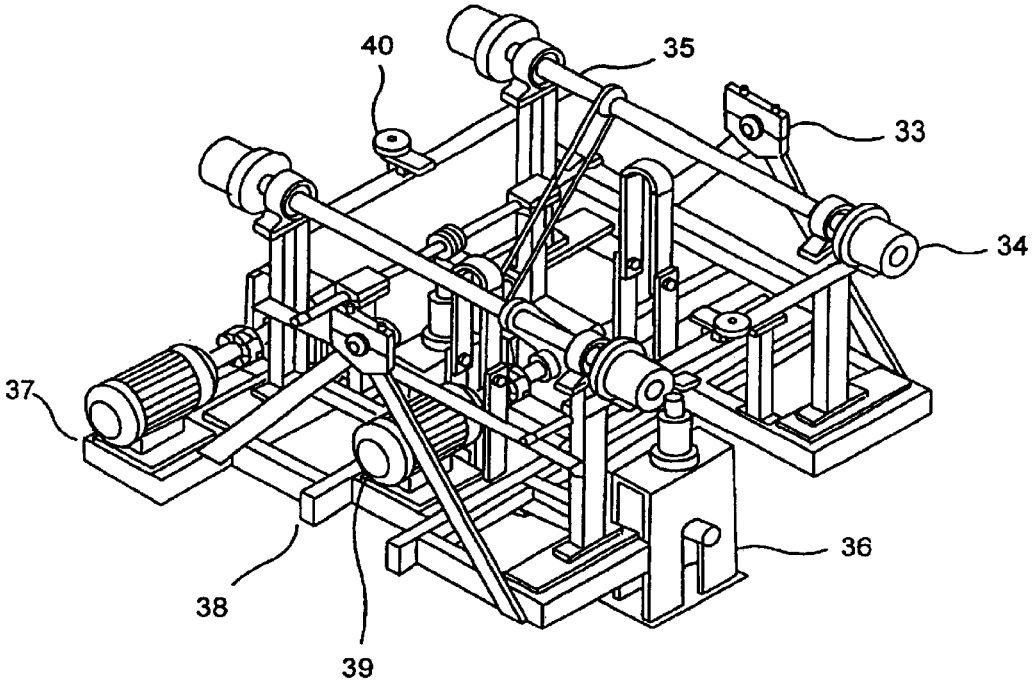
FIG. 6 represents the parts and pictorial view of the rotating and oscillation mechanisms of the improved device for leather processing (IDLP) of the present invention.

Different parts of FIG. 6 are as follows.

33. refers to the clamp mechanism to hold and oscillate the main shaft.
34. refers to the friction rollers.
35. refers to the connecting shafts of the friction rollers.
36. refers to the oscillating /rocking assembly.
37. refers to the power transmission source for oscillating the vessel
38. refers to the driving mechanism for the connecting shafts.
39. refers to the power transmission source for rotation of the vessel.
40. refers to the supporting roller assembly.

Figure 7:
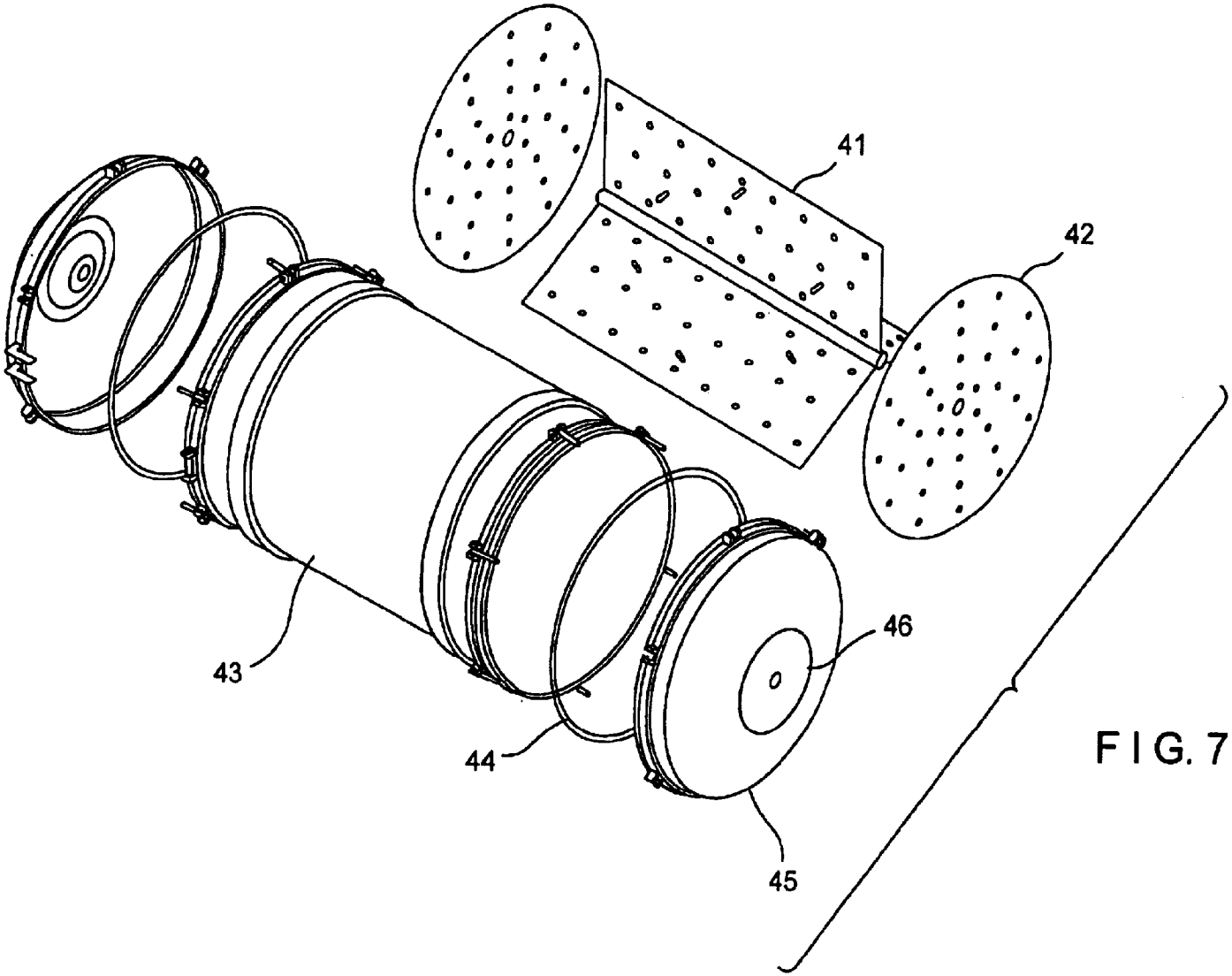
FIG. 7 represents the pictorial view and parts of the vessel of the IDLP of the present invention.

Different parts of FIG. 7 are as follows.

41. refers to the perforated compartments with pegs.
42. refers to the perforated dummy door.
43. refers to the openable aperture for intermediate pH checking.
44. refers to the leak proof packing to avoid any leakage.
45. refers to the outlet to drain the liquid.
46. refers to the inlet for water, chemical solution and air.

Figure 8:
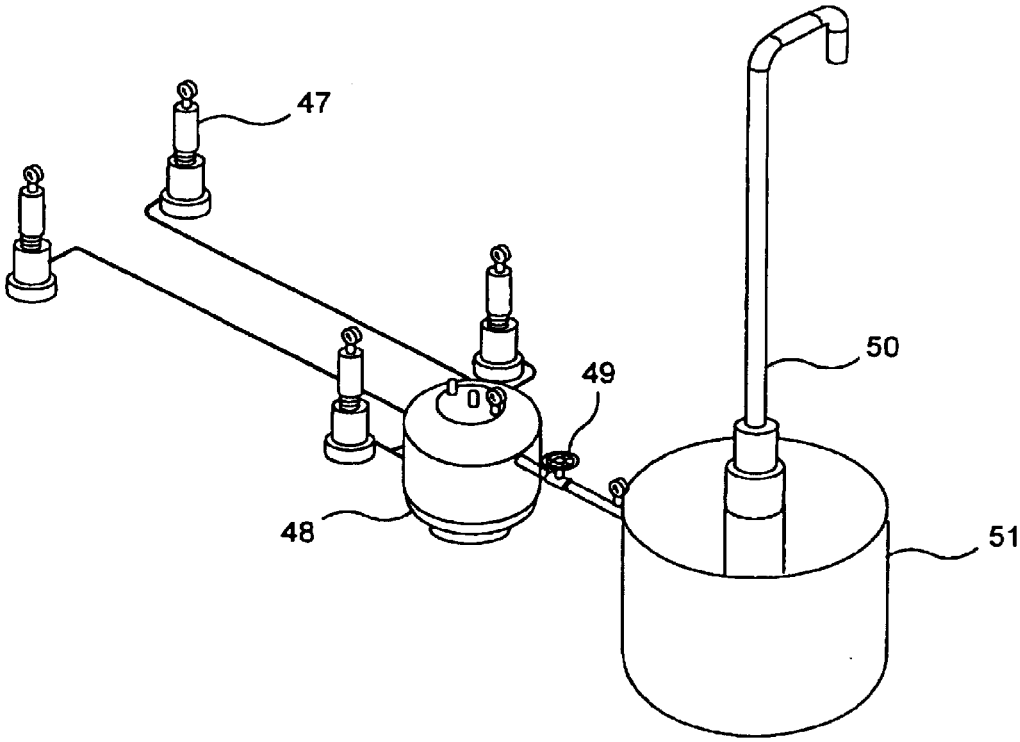
FIG. 8 represents the assembly and parts of the pneumatic system of the IDLP of the present invention.

Different parts of FIG. 8 are as follows.

47. refers to the source for air generation (by perpetual motion of the device).
48. refers to the air chamber.
49. refers to the valves.
50. refers to the air lifters to eject the solution from the container to the vessel
51. refers to the container for liquid.

The device is essentially a frame assembly (30) housing a vessel (27) divided into more than one perforated compartment (41) fitted with pegs. The compartments help in distributing the load throughout the vessel, thereby reducing the starting torque. Not less than two-friction disks (28) are fixed along the exterior periphery of the vessel (27). Friction disks (28) are positioned on friction roller (34), that rotates by the driving mechanism (38) connected to a power transmission source (39), through the connecting shafts (35), thereby enabling the vessel (27) to exhibit upward and downward rotary motion. A supporting roller assembly (40), positioned at one side of the disk (28) ensures that no slip occurs to the frame assembly (30) during the motion. There are two dome shaped caps (31) on either side along the horizontal axis of the vessel (27). Both the caps are connected internally to perforated dummy door (42) along with leak proof packing (44) and are also provided with inlet (46) fixed at the center as well as outlet (45) at the bottom to drain out liquid. At least one of the dome shaped caps (3 1) is openable to ensure that the hides/skins to be processed can be put inside as well as taken out. The opening as well as closing of the dome shaped caps (31) is controlled by conventional locking mechanism (29). The entire unit, as described above, is connected to another known oscillating/rocking assembly (36), which drives its motion from another power transmission source (37), thereby ensuring rotary as well as oscillatory motion of the vessel (27). The bottom of the oscillating/rocking assembly (36), is provided with more than one source for air generation (47), air chamber (48), valves (49) air lifter (50) and container (51), all connected internally, thereby forming a pneumatic system, which is used for continuous addition of chemicals during processing. After all the chemicals are added to the vessel through the opened valve, air from the air chamber is led into the system, thereby generating inside the vessel pneumatic pressure, that quicken the processing. The entire assembly, as described above, is held by a main shaft (32) supported by two bearings. After taking the hide/skin to be processed inside the vessel (27) through the dummy door (42), the same is closed and the power transmission source (39) is switched on to start the rotary motion of the vessel (27). Then the power transmission source (37) is switched on to start the oscillatory motion of the vessel (27). The oscillator motion of the device facilitates drawing of air from the source for generating air (47) fixed at the bottom of the oscillatory assembly (36), and subsequent passing of the same air to the air litter (50) through the air chamber (48) with the help of connecting lines and valves (49) facilitates letting the liquid from the container (51) into the vessel (27). Necessary chemicals are then added to the vessel from time to time. The persisting drawing of air after the transfer of the chemical solution from the container (51) to the vessel (27) facilitates generating pneumatic pressure, which not only helps in uniform mixing of chemicals but also accelerates the processing. This rotary cum oscillatory motion of the vessel (27) ensures the stock under processing to multiple mechanical actions. Intermittent monitoring, if necessary, may be done by opening an aperture (43) provided on the external periphery of the vessel (27). At the end of the processing, the cap (31) is opened and the processed stock is unloaded by gravity.

The novelty and non-obviousness of the present invention lies not only in providing a single vessel system exhibiting both oscillatory as well as rotary motion, thereby facilitating float turbulence as well as mixing of chemicals coupled with effective movement as well as automatic unloading of the hides/skins under processing, but also in using the oscillatory system of the device as a source for the generation of pressure inside the vessel and the pressure generated thereby being used as a pneumatic source for continuous addition of chemicals, thereby avoiding use of any external pneumatic source, resulting in economic utilization of energy and also providing a cost effective option for leather processing.

The following examples are given by way of illustration only and therefore should not be construed to limit the scope of the present invention.

EXAMPLE 1

101 Kgs of limed buffalo pelt, duly fleshed and washed thoroughly, were taken in the fiber reinforced plastic vessel having three perforated compartments. The perforated dummy door and the dome shaped cap, both made of fiber reinforced plastic, were then closed by using bolt and nut assembly installed in the device. The leak-proof material used for the vessel was nytrile rubber. Water, measuring 100 Lts., was added to the vessel through the inlet for washing operations. The rotary and oscillator mechanisms of the vessel were then switched on one by one. The vessel containing the pelt started oscillating at 8 oscillations per minute (opm) and rotating at 10 revolutions per minute (rpm) with the help of Teflon rollers mounted on the mild steel connecting shafts. The drive in respect of the oscillatory and rotary motions of the vessel was drawn by the hydraulic system and gearbox unit respectively. The direction of rotation of the vessel changed for ever 10 minutes to upward and downward just by changing the change over switch for easy mixing of chemicals with the water and for quickening the process.

After a period of 15 minutes, the deice was switched off and the water was drained out by opening the outlet. The same procedure was adopted for washing the pelt for second time. Water, measuring 70 Lt., was added to the vessel through the inlet for deliming operations, 1 kg of ammonium sulfate was then dissolved in 5 lit. of water and the resulting solution was taken in the container, connected to the air pump, air chamber and valves through connecting lines.

The device was switched on in the similar manner. The oscillatory motion of the device facilitated drawing of air from the air pump fixed at the bottom of the oscillatory assembly and subsequent passing of the same air to the air lifter through the air chamber with the help of connecting line and valve. The opening of the valve placed between the air chamber and the container facilitated in letting the liquid from the container into the vessel. As soon as all the liquid had been drawn in the vessel, the continued drawing of air facilitates the generation of phnumatic pressure, which was measured to be 3 kg/cm$^2$, inside the vessel.

After a period of 90 minutes, the vessel was switched off and the aperture was opened for pelt pH checking. The completion of deliming was confirmed using phenolphthalein indicator. The aperture was then closed and the vessel was kept in such a position that the outlet was opened and faced downward, thereby letting the water out by gravity. Then the out let of the domed shaped cap as closed. The subsequent operation of washing, pickling, chrome tanning was carried out in a similar way. Completion of pickling was confirmed by opening the aperture in a way as already mentioned above.

Exhaustion of chrome was also checked in a similar way by opening the outlet and taking out a sample of the chrome liquor in a glass container.

Finally vessel was switched off and the domed shaped cap with the perforated dummy door was opened. The vessel was then positioned in a slanting condition by adjusting the oscillatory mechanism, which was stopped as soon as the vessel had assumed the said position.

The rotary system was then switched on whereby the tanned wet blue was drawn out automatically by gravity. The leathers were then piled.

EXAMPLE 2

54 kgs of shaved weight wet blue where taken in the stainless steel vessel having two perforated compartments. The perforated dummy door both made of stainless steel, and the dome shaped cap of the vessel where then closed by using cam assembly installed in the device. The leak-proof material used for the vessel as spongy rubber. Water, measuring 50 Lt., was added to the vessel through the inlet for washing operation by adding 130 grams of formic acid and run for 30 minutes. After that the water was drained out by just opening the outlet. The rotary and oscillatory mechanism of the vessel was then switched on one by one. The drive in respect of the oscillatory and rotary motions of the vessel was drawn by the cam mechanism and gearbox unit respectively. The direction of rotation of the vessel changed for every 10 minutes to upward and downward automatically by timer controlled system for easy mixing of chemicals with the water for quickening the process.

The vessel containing the wet blue started oscillating at 10 opm. and rotating at 10 rpm with the help of the cast iron friction rollers mounted on the stainless steel connecting shaft. Water, measuring 50 Lts., was added to the vessel through the inlet for chrome tanning. 2.5 kgs Basic Chromium Sulfate powder dissolved in 5 lit. of pickle water and the resulting solution was added in one feed into the vessel through the inlet manually. After a period of 40 minutes the vessel was switched off. The completion of chrome exhaustion was checked by collection of the chrome liquor in a glass container.

320 grams of soda ash was then dissolved in 2 litres of water and resulting solution was manually added in 3 feeds. The drum was then rotated as well as oscillated for a period of 30 minutes. Completion of neutralization operation was confirmed by opening the openable aperture for checking the pH of the leather. The aperture was then closed and the vessel was kept in such a position that the outlet was opened and faced downward, thereby letting the water out by gravity. The device was again switched on after closing the same outlet.

Water, measuring 50 Lts., was added to the vessel through the inlet for Fatliquoring, dying and fixing operations. Then 5.6 Kgs of synthetic fat liquor was emulsified well in hot water. The resulting fatliquor emulsion was added in to the oscillating vessel through the inlet. After a period of 35 minutes 350 grams of black dye was taken and mixed with 1 lit of water and the resulting solution added into the vessel, while allowing the device to oscillate for another 35 minutes and then 500 gms of formic acid, dissolved in 5 lit. of water was added to the vessel through the inlet in three feeds. After a period of 30 minutes the device was switched off. Then checked for exhaustion and for penetration. Finally the tanned leather was taken out by opening the domed shaped cap with the perforated dummy door kept the vessel in a convenient position and rotate the vessel for few minutes so as to unload the processed stock by gravity automatically and were piled.

EXAMPLE 3

185 Kgs assorted crust as taken in the stainless steel vessel having thee perforated compartments. The dome shaped cap with the perforated dummy door made of fibre glass reinforced polymer of the vessel was then closed by using rack and pinion mechanism installed in the device. The leak-proof material used for the vessel was nytrile rubber. Water, measuring 200 Lts., was added to the vessel through the inlet for wetback operation by adding 1.5 kgs of wetting agent and 600 grains of ammonia. The rotary and oscillatory mechanisms of the vessel were then switched on one by one. The vessel containing the leather started oscillating at 4 opm and rotating at 6 rpm with the help of the nytrile rubber rollers mounted on the cast iron connecting shafts. The drive in respect of the oscillatory and rotary motions of the vessel was drawn by the spatial mechanism and belt drive respectively. The direction of rotation of the vessel changed for every 10 minutes to upward and downward automatically by timer controlled system for easy mixing of chemicals with the water and for quickening the process.

After 6 hours the device was switched off and the leather was checked by opening the aperture. The wetting back was found o.k. After closing the aperture the device was switched on and kept the vessel in such a position that the outlet was opened and faced downward, thereby letting the water out by gravity. Then the outlet was closed. Water, measuring 100 Lts., was added to the vessel through the inlet for Fatliquoring, dying and fixing operations. Then 18 Kgs of synthetic fatliquor was emulsified well in hot water. The resulting solution was taken in the container. Then device was switched on in the similar manner. The oscillatory motion of the device facilitated drawing of air from the air pump fixed at the bottom of the oscillatory assembly and subsequent passing of the same air to the air lifter through the air chamber with the help of connecting line and valve. The opening of the valve placed between the air chamber and the container facilitated in letting the liquid from the container into the vessel. As soon as all the liquid had been drawn in the vessel, the continued drawing of air facilitates the generation of pneumatic pressure, which was measured to be 2 kg/cm$^2$, inside the vessel. After a period of 45 minutes 5 kgs of black dye was taken and mixed with 6 lits of water and the resulting solution added into the vessel as per the said method. The vessel was allowed to oscillate and rotate for another 60 minutes and then 750 gms of formic acid, dissolved in 5 lit. of water was added to the rotating vessel through the inlet continuously. After a period of 30 minutes the device was switched off. Then the aperture was opened. The liquor was collected for checking exhaustion of liquor. After that processed leather was taken out for checking uniform penetration of dye materials and found o.k. Finally the tanned leathers was taken out by opening the domed shaped cap with the dummy door and kept the vessel in a convenient position and rotate the vessel for few minutes so as to unload the processed stock by gravity automatically and were piled.

EXAMPLE 4

150 kgs of shaved weight wet blue were taken in the seasoned wood vessel having two perforated compartments. The dome shaped cap with the perforated dummy door of the vessel, made of stainless steel were then closed by using rack and pinion assembly installed in the device. The leak-proof material used for the vessel was spongy rubber. Water (150 Lt.) was added to the vessel through the inlet for washing operation by adding 400 grains of formic acid. After 30 minutes the device was switched off and kept the vessel in such a position that the outlet was opened and faced downward thereby letting the water out by gravity. Then the outlet was closed.

The rotary and oscillatory mechanisms of the vessel were then switched on one by one. The drive in respect of the oscillatory and rotary motions of the vessel was drawn by the hydraulic system and gearbox unit respectively. The direction of rotation of the vessel changed for every 10 minutes to upward and downward automatically by timer controlled system for easy mixing of chemicals with the water and for quickening the process.

The vessel containing the wet blue started oscillating at 8 opm, and rotating at 8 rpm with the help of the cast iron friction rollers mounted on the stainless steel connecting shafts. Water, measuring 150 Lts., was added to the vessel through the inlet for chrome tanning. 7.5 kgs of Basic Chromium Sulfate powder dissolved in 15 lit. of water and the resulting solution was added in one feed into the vessel through the inlet by manually. After a period of 40 minutes the vessel was switched off. The completion of chrome exhaustion was checked by collecting the chrome liquor by opening the outlet. After that the outlet was closed. Then 1 Kg of soda ash dissolved in 10 litres of water and the resulting solution was added in 3 feeds by manually for a period of 30 minutes. Then the drum was rotated as well as oscillated for another period of 30 minutes. The completion of neutralization operation was confirmed by opening the openable aperture for checking the pH of the leather, which was found to be 4.5. The aperture was then closed and the vessel was kept in such a position that the outlet was opened and faced downward, thereby letting the water out by gravity. The device was again switched on after closing the same outlet. Water, measuring 150 Lts., was added to the vessel through the inlet for Fatliquoring, dying and fixing operations. Then 16 Kgs of synthetic fat liquor was emulsified well in hot water. The resulting fatliquor emulsion was added in to the oscillating vessel through the inlet. After a period of 35 minutes 1 kg of black dye was taken and mixed with 3 lit of water and the resulting solution added into the vessel, while allowing the device to oscillate for another 35 minutes and then 1.5 Kgs of formic acid, dissolved in 10 lit. of water was added to the vessel through the inlet in three feeds. After a period of 30 minutes the device was switched off for checking. Finally the tanned leather was taken out by opening the domed shaped cap with the perforated dummy door, kept the vessel in a convenient position and oscillate the vessel for few minutes so as to unload the stock by gravity automatically and were piled.

The main advantages of the present invention are the following.

1. The vessel of the device undergoes rocking action, which enables an operator to adjust it in a convenient position so as to load and unload the processed stock by gravity automatically, thereby not only doing away with the extra labor associated with loading and unloading, but also in reducing time.
2. Since the light weight vessel is rotated by the friction rollers, the starting torque and the running torque of the device are equal, as against much higher values (three times) for the existing tanning drum, thereby reducing the power requirement considerably.
3. The use of fabrication friendly materials like fiber reinforced plastic and stainless steel ensures ease in fabrication for the vessel, which is provided as a molded single unit structure for material saving,
4. Unlike in the conventional tanning drum, the device of the present invention ensures, the parameter like cross section pH of the leather and liquor pH can be measured by opening the aperture without opening the vessel main door thereby saving time at least 2 minutes for each time of monitoring.
5. Unlike in the conventional tanning drum, the device of the present invention facilitates with short float for leather processing, resulting in better absorption of chemicals, higher exhaustion of bath and less effluent load to reduce the cost in production are ensured.
6. This gentle multiple mechanical actions of the device facilitates easy movement of the goods inside the vessel to reduce the friction of skin slippage for quality improvement.
7. This vessel, is divided into compartments for distribution of working load (float+skin/side) and occupies 75 to 80% of the volume of each compartment as in the conventional tanning drum concentrated load occupies only 35%.
8. Unlike in the conventional tanning drum where feeding of chemical solution normally made manually, the device of the present invention facilitate addition of chemical solution into the vessel with the help of perpetual motion of the device.
9. Unlike in the conventional tanning drum where direction of rotation of the drum normally in one direction, the device of the present invention facilitate both upward and downward direction of the vessel apart from oscillatory motion to reduce the processing time.

We claim:

1. Device for leather processing comprising a cylindrical vessel encasing a plurality of perforated longitudinal compartments fitted with a plurality of pegs and having at least two dome shaped caps on either side along the horizontal axis, at least one of said caps being openable, all the caps being provided with respective co-centric inlets and respective bottom draining outlets, the caps being connected internally by a perforated dummy disc door having a leak proof packing, the vessel being provided with a peripheral openable aperture, and at least two friction bands fixed on its exterior periphery, said bands being provided on the side thereof with supporting roller assembly capable of preventing any slip during motion, the vessel being placed on friction rollers, said rollers being rotated through connecting shafts by a power transmission source capable of causing rotary motion of the vessel in upward as well as downward directions, the entire vessel and all its elements above being connected to a rocking/oscillating assembly in turn connected to a second power transmission source, to provide a combination of rotary and oscillatory motion.

2. A device as claimed in claim 1 wherein the bottom of the rocking/oscillating assembly is provided with an air generation means, an air chamber, a plurality of valves, air lifters, and chemical container all connected and forming a self generating pneumatic system for continuous addition of chemicals during processing, thereby ensuring the addition of liquid either manually or by said pneumatic system through the inlet, the entire assembly being held by a main shaft supported by two bearings, said shaft being held by a frame assembly.

3. A device as claimed in claim 1 wherein the opening as well as closing of the openable cap being controlled by a clamp.

4. A device as claimed in claim 1 wherein the vessel, dome shaped cap, chemical container and perforated dummy door are made of material selected from group comprising non-corrosive stainless steel, chemical resistant fiberglass reinforced polymer and seasoned wood.

5. A device as claimed in claim 1 wherein the material used for friction disk, supporting roller assembly, friction roller, frame assembly, rocking/oscillating assembly, rotating assembly, main shaft, connecting shaft, clamp mechanism, is selected from group comprising stainless steel, mild steel, cast iron, Teflon, nitrile rubber and fiber glass reinforced polymer.

6. A device as claimed in claim 1 wherein the bearings are selected from the group consisting of a self-aligned bearing, journal bearing and ball bearing.

7. A device as claimed in claim 5 wherein the friction rollers are made from a material selected from the group consisting of nitrile rubber, Teflon, polyvinyl chloride, polyurethane, cast iron, brass and aluminum.

8. A device as claimed in claim 1 wherein the power transmission source comprises an electric motor.

9. A device as claimed in claim 1 wherein the openable dome shaped cap is opened and closed by opening means selected from the group consisting of a bolt and nut assembly, rack and pinion assembly, pneumatic assembly and a cam assembly.

10. A device as claimed in claim 1 wherein the rocking/oscillating assembly is selected from the group consisting of a cam mechanism, connecting rod mechanism, hydraulic system and a spatial mechanism.

11. A device as claimed in claim 1 wherein the driving mechanism to rotate both upward and downward directions for the connecting shaft used is selected from the group consisting of a gear drive, chain drive and a belt drive.

12. A device as claimed in claim 1 wherein the leak proof packing material used is selected from the group consisting of hardened rubber, nitrile rubber and spongy rubber.

13. A device as claimed in claim 1 wherein the air generating means is selected from the group consisting of piston cylinder, air pumps and bellows.

14. A device as claimed in claim 1 wherein the air chamber and air lifter are made of a material selected from the group consisting of stainless steel, mild steel and brass.

* * * * *